US005332334A

United States Patent [19]

Wagner et al.

[11] Patent Number: 5,332,334

[45] Date of Patent: Jul. 26, 1994

[54] TUNNEL WALL WITH LINING

[75] Inventors: Harald Wagner, Mauthausen; Alfred Schulter, Linz, all of Austria

[73] Assignee: Ingenieure Mayreder, Kraus & Co. Consult Gesellschaft M.b.H., Linz, Austria

[21] Appl. No.: 19,245

[22] Filed: Feb. 18, 1993

[30] Foreign Application Priority Data

Feb. 21, 1992 [AT] Austria ..... 323/92

[51] Int. Cl.[5] ..... E21D 11/05

[52] U.S. Cl. ..... 405/153; 405/151

[58] Field of Search ..... 405/150.1, 151, 152, 405/153, 146

[56] References Cited

U.S. PATENT DOCUMENTS 4,812,084 3/1989 Wagner et al. ..... 405/153

FOREIGN PATENT DOCUMENTS 389149 10/1989 Austria .
2101092 8/1972 Fed. Rep. of Germany .
2627802 9/1989 France .
823500 5/1981 U.S.S.R. .

*Primary Examiner*—David H. Corbin
*Attorney, Agent, or Firm*—Collard & Roe

[57] ABSTRACT

A tunnel wall with a lining is comprised of substantially trapeze- or trapezoid-shaped tubbing stones (8–13), which are at least similar and complement each other in an even number to form a respective tubbing ring (7), the tubbing stones being held together at their end faces (14, 15) defining the annular gap after mounting by dowel-like plug connections permitting a limited transfer of shearing forces and along the oblique longitudinal gaps (16) by groove-spring connections consisting of springs (18) inserted into longitudinal grooves (17) extending along the oblique longitudinal sides. To provide the lining with resilience against the pressure of the rock formation, compressible springs (18) are provided which, in the unstressed state, hold the stones (8–13) at a distance to form longitudinal gaps and which are compressible under the pressure of the rock formation to reduce the width of the gaps, and the tubbing stones are connected at their end faces (14, 15) with the neighboring tubbing stone in the succeeding tubing ring (7) by a single center dowel (19).

5 Claims, 2 Drawing Sheets

TUNNEL WALL WITH LINING

Figure 1:
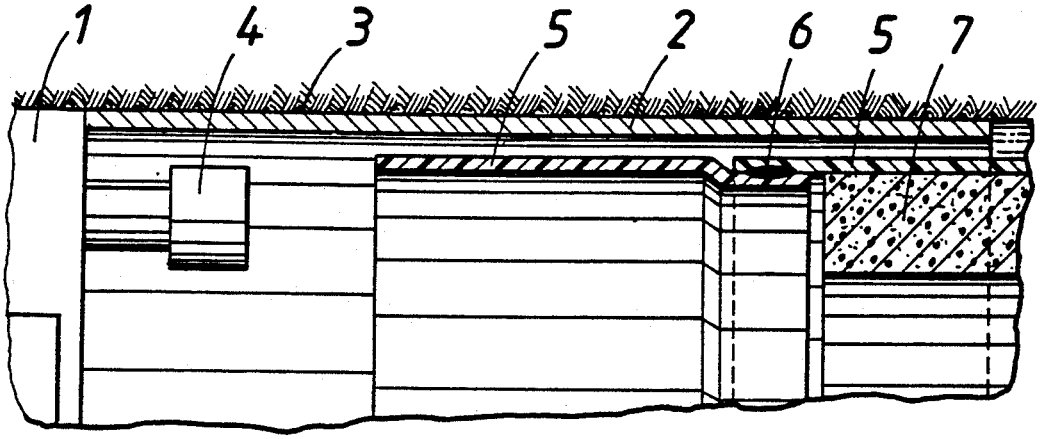

The invention relates to a tunnel wall with a lining comprising a succession of tubbing rings each comprised of an even number of like, substantially trapeze- or trapezoid-shaped tubbing stones complementing each other to form respective ones of the tubbing rings, each tubbing stone having opposite end faces and oblique longitudinally extending side faces, the end faces of the tubbing stones of adjacent ones of the tubbing rings defining respective annular gaps between the adjacent tubbing stones and the side faces of adjacent ones of the tubbing stones of each tubbing ring defining respective longitudinal gaps between the adjacent tubbing stones.

Such a tunnel wall is known from Austrian patent No. 389,149. It is the fundamental advantage of this type of tunnel wall that pre-fabricated parts, which may be interconnected in a modular assembly system to form tubbing rings, can be used, the tubbing rings being held together by a doweling system so that the stones may be built in immediately following the excavation and possibly under the protection of the shield tail of a forward thrust machine. Deviations in the direction of the tunnel wall from a straight line may be obtained by using tubbing stones which complement each other in the formation of tubbing rings with end faces defining planes enclosing an acute angle, two oppositely assembled rings producing a tubular cylinder with parallel end faces but rotation of the rings from this position enabling the wall to deviate to the sides and upwards and downwards. In the known embodiment, the springs constitute essentially gliding guides for assembling the stones and the stones contact each other at the oblique edges almost without a gap. Seals may be inserted in these gaps, as well as in the ring gaps.

In other known tunnel linings, a limited radial resilience is used with floors and rock formations having a poor bearing capacity and/or a high deformation potential to enable the lining to be constructed with pre-fabricated parts in an economical building mode, on the one hand, and to be able to use structural elements which may be economically produced, on the other hand. The radial deformability of the lining results in the earth and rock pressure first deforming the lining to a predetermined extent against the deformation resistance defined by the yielding elements. A sufficient measurement of the possible deformation path on the basis of the earth and/or rock properties enables the earth and/or rock pressure to be reduced with increasing deformation, that is, that the rock comes to rest after a defined deformation path has been passed, so that the wall is subjected to less stress than a rigid wall. Shafts and tunnels under high loads or great rock pressure conditions in transit routes through the Alps may be cited as an example of additional possible uses of a tunnel or shaft lining of the present type.

It has been conventional heretofore to provide a large gap in the building of tunnel linings. According to French patent publication No. 2,627,802, reception housings for yielding elements are mounted between substantially rectangular, corrugated or of corrugated steel material manufactured tubbing stones, which are connected to the adjacent longitudinal edges of the tubbings by screwing, optionally with the interposition of seals. In other conventional embodiments, rod-shaped yielding elements are mounted in the gap, which are supported by the edges of the two lining elements adjoining the gap or which are even partially housed in these edges. An embodiment is known wherein the edge of the one element facing the gap carries support plates on which rams constituting deformable bodies may be supported and may be glidably moved into tubes projecting from the edge of the other element and being built into it, clamping bodies or machined bodies having an indenting effect on the rams being provided at the tube ends so that an exactly defined resistance is opposed to the insertion of the rams into the tubes. It is known from German patent No. 2,101,092 to insert yielding inserts of wood or chipboard between adjoining tubbings. Soviet patent No. 823,500 provides concrete tubbings with rectilinear parallel longitudinal edges defining depressions, which may be V-shaped grooves, for example, and to use these depressions for the support of metallic yielding elements, a further concrete filling of gaps not needed as compression zones being possible. With the exception of the construction according to the mentioned French patent publication, the complete wall of the tunnel is partially unstable because of the gaps. A further limitation to the usefulness results in all the known constructions from the fact that only structural elements with edges extending parallel to the longitudinal axis of the tunnel can be used when the yielding elements are mounted on the edges of the structural elements. Furthermore, different measurements in the total wall result from compression zones which are applied only in certain areas because of the larger gaps for the housing of the yielding elements, which leads to the necessity of utilizing tubbings of larger circumferential measurements in the areas that a free of compression zones.

It is the object of the invention to provide a tunnel wall of the first-indicated type, in which a radial yielding of the lining is obtained with simple means, if required, it being also possible to obtain a dependable and secure gas and water seal of the tunnel tube with simple means.

The above object is accomplished in a tunnel of the first-described type by providing a dowel plug connection between each tubbing stone and an adjacent tubbing stone of the adjacent tubbing ring, the dowel plug connection permitting a limited transfer of shearing forces therebetween, and compressible springs having a circular cross section arranged in the longitudinal gaps, the side faces of adjacent one of the tubbing stone in each tubbing ring defining longitudinal grooves having a mating cross section to form groove-spring connections holding the adjacent tubbing stones at a distance in the unstressed condition of the springs and permitting the width of the longitudinal gaps to be reduced upon compression of the springs under the pressure of the rock formation through which the tunnel extends.

With the tunnel wall according to the invention, it is possible to use a tunnel boring machine with a yielding shield mantle and shield tail, and to assemble the tubbing stones and to connect them to the previously completed tubbing rings under the protection of the shield tail, the forward thrust presses required for the tunnel boring machine being usable for pressing the stones against the previously placed rings. It is decisive that there is the possibility of continuously opposing a sufficient resistance to the rock formation, which is provided first by the yielding shield tail and then by the tunnel tube which is, of course, compressible only when subjected to resistance so that loosening of the rock formation is largely avoided and the rock formation reaches its new equilibrium with optimally small deformation paths. The deformable springs constitute yielding elements which may be placed and manufactured in a considerably easier manner than the yielding elements used in conventional tubbing walls, and they fulfill this function in addition to their basic function as a connection of the oblique sides of the tubbing stones. They may be used additionally, optionally in conjunction with gap sealing bands, for sealing the oblique gaps. It is also essential for the invention that each tubbing stone is connected at each end face to the adjoining stone of the succeeding ring only with a single, centered dowel so that a certain resilience is obtained in the connection at the various gaps under different settling movements. The stones of adjoining rings may be oriented in the same direction, the base of the one stone being adjacent the smaller parallel side of the succeeding stone in adjoining rings. This produces in the basic form sawtooth-shaped longitudinal gaps along the succeeding rings, the oblique flank of the saw tooth being formed by the portion of the annular gap. Another possibility is to have the base and the small side of the stones of successive rings abut each other so that the longitudinal gaps formed thereby continue over the entire tunnel tube with opposite inclination. The springs preferably have a tubular cross section and may have a softer filling, which may optionally be pressed out against a defined resistance.

Because of the oblique position of the longitudinal edges of the stones and the cooperation of the grooves with the springs, a pivotal displacement of adjoining stones relative to each other is largely prevented. In one embodiment, the longitudinal side faces have mating and overlapping steps, each one of the steps of the side faces defining a respective one of the longitudinal gaps receiving a respective one of the springs. The superposed faces of the steps in the overlapping zone form additional guides which prevent a tilting of individual stones.

An envelope may be formed by a sealing membrane surrounding the tubbing rings at least in the area of gas- or water-carrying zones of the rock formation. The envelope is also applied under the protection of the shield tail of the tunnel boring machine and, because of its resilience, enables the deformation of the yielding elements without lifting off the periphery of the tunnel tube. Additionally, the membrane may also be pressed against the tubbing rings by material injected through the annular gap between the tunnel tube and the excavation. Such an injectable material assures a uniform transmission of the rock pressure to the entire tunnel tube and also prevents gas and water from entering through the said annular gap and being spread outside along the length of the tunnel.

Preferably, the envelope is comprised of annular sections applied according to the progress of excavation, and the annular sections are sealingly arrayed adjoining each other, the tubbing stones being inserted in the annular sections to form the tubbing rings.

Further details and advantages of the invention may be gleaned from the following description of the drawing.

Figure 2:
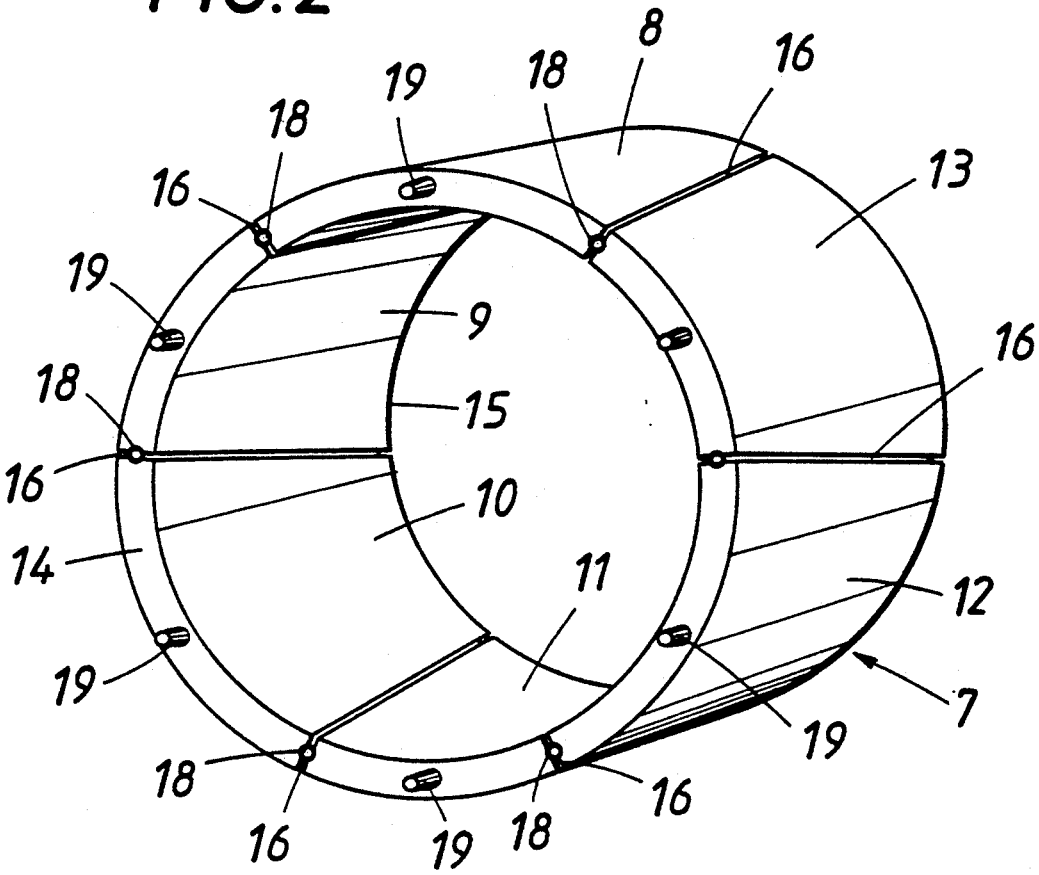

The invention has been illustrated in the drawing by way of example. Shown are in FIG. 1, highly schematically and in longitudinal section, a tunnel during the forward thrust in the excavation zone in the range of the shield tail and the last, just completed tubbing ring, FIG. 2 a perspective view of a tubbing ring for use in a tunnel lining according to the invention, FIG. 3, in detail, a front view of two connected tubbing stones, and FIG. 4 a modified embodiment of FIG. 3.

A round excavation 3 corresponding to the cross section of the tunnel is produced with a tunnel boring machine 1 with a yielding shield tail 2. The tunnel boring machine is equipped with forward thrust presses 4 which may also be used to press together the subsequently described tubbing stones in successive tubbing rings.

Sealing membranes consisting of annularly closed sections 5, which overlap the edges of previously laid sections along their edges 6 and are there tightly connected by welding, bonding, gliding joints and the like, are placed under the protection of the yielding shield tail in critical excavation zones potentially accessible to the entry of water or gas.

Also under the protection of shield tail 3, tubbing stones are joined to previously completed tubbing rings to form further tubbing rings 7. Each tubbing ring consists of an even number, six in the example, of tubbing stones 9–13 which, if no deviation from a straight course of the tunnel axis is required, have parallel end faces 14, 15 defining the annular gaps. If deviations from a straight course of the tunnel tube are required, pairs of like tubbing stones are used, which produce tubbing rings having end faces enclosing an acute angle, and deviations are obtained by assembling successive tubbing rings from corresponding stones by relative rotation to each other.

Figure 3:
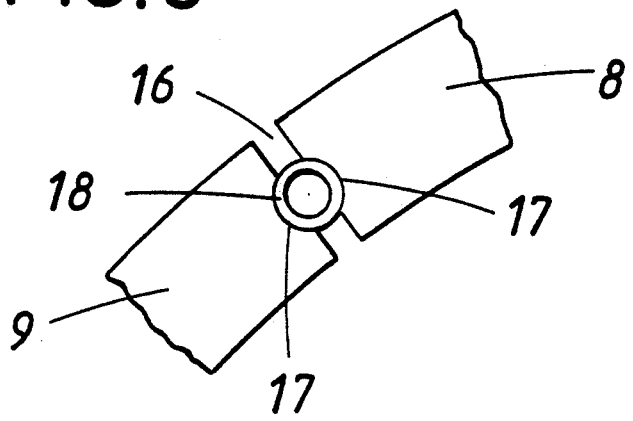

The tubbing stones 9–13 have oblique longitudinal sides wherebetween corresponding obliquely extending longitudinal gaps 16 are defined. The oblique sides define semi-circular grooves 17 in which springs 18 of round cross section, which are tubular according to FIG. 3, are placed, the springs being of a compressible material generating a corresponding deformation resistance. Under the pressure of the rock formation, the width of gaps 16 may be changed, therefore, by the deformation of springs 18.

Each stone 6–13 has an opening in the center of the end faces into which a dowel 19, which is designed to engage the associated opening of the adjoining stone in the succeeding ring, may be plugged. These dowels permit the transmission of shearing forces and are essentially so shaped and made of such a material that they are anchored in the associated insertion openings, which may optionally be equipped with counter-holders.

Figure 4:
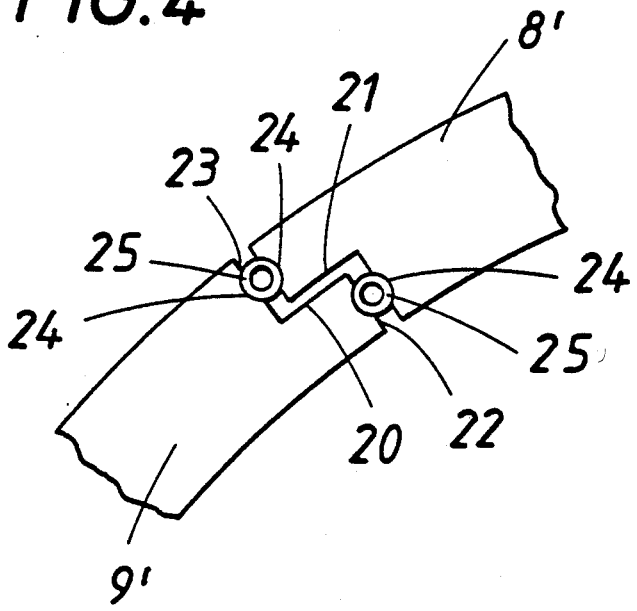

In the embodiment of FIG. 4, the oblique longitudinal sides of two successive stones 8', 9' are stepped so that the facing flanks 20, 21 constitute support and guide faces. The steps 22, 23 are again formed with mating grooves 24 for receiving tubular springs 25.

In a non-illustrated embodiment, the resilient springs 18 extending along the length of the stones may be replaced by deformable dowels. In this case, the tubbing stones 8–13 may be, for example, staggered from each other by half a stone width in successive tubbing rings 7 and each individual stone may be connected at each end face to the two abutting stones in the adjoining ring by at least two dowels. The arrangement is made so that the deformable dowels hold the connected stones with the formation of the gaps important for the resilience of the lining while the gaps may be closed under the deformation forces. Combinations of deformable springs and yielding dowels are possible.

We claim:

1. A tunnel wall with a lining comprising a succession of tubbing rings each comprised of an even number of like, substantially trapeze- or trapezoid-shaped tubbing stones complementing each other to form respective ones of the tubbing rings, each tubbing stone having opposite end faces and oblique longitudinally extending side faces, the end faces of the tubbing stones of adjacent ones of the tubbing rings defining respective annular gaps between the adjacent tubbing stones and the side faces of adjacent ones of the tubbing stones of each tubbing ring defining respective longitudinal grooves between the adjacent tubbing stones, a dowel plug connection between each tubbing stone and an adjacent tubbing stone of the adjacent tubbing ring, the dowel plug connection permitting a limited transfer of shearing forces therebetween, and compressible springs having a circular cross section arranged in the longitudinal grooves, the longitudinal grooves having a mating cross section to form groove-spring connections holding the adjacent tubbing stones at a distance in the unstressed condition of the springs and permitting the width of the longitudinal gaps to be reduced upon compression of the springs under the pressure of the rock formation through which the tunnel extends.

2. The tunnel of claim 1, wherein the springs have a tubular cross section.

3. The tunnel of claim 1, wherein the longitudinal side faces have mating and overlapping steps, each one of the steps of the side faces defining a respective one of the longitudinal grooves receiving a respective one of the springs.

4. The tunnel of claim 1, wherein the dowel plug connection between each tubbing stone and an adjacent tubbing stone of the adjacent tubbing ring is a single center dowel.

5. The tunnel of claim 1, wherein the tubbing stones of the adjacent tubbing rings are staggered from each other by half a ring width and each tubbing stone has two deformable dowel plugs to form said connections.

* * * * *